United States Patent [19]

Gold

[11] Patent Number: 4,471,518

[45] Date of Patent: Sep. 18, 1984

[54] METHOD OF MAKING A SLEEPING BOX

[76] Inventor: Paul B. Gold, 48 Marshall St., Newton, Mass. 02159

[21] Appl. No.: 437,566

[22] Filed: Jan. 30, 1983

[51] Int. Cl.[3] ..... B23P 11/02

[52] U.S. Cl. ..... 29/450; 29/526 R; 2/69.5; 2/84; 5/413

[58] Field of Search ..... 29/428, 450, 526 R; 5/413; 2/69.5, 84

[56] References Cited

U.S. PATENT DOCUMENTS

| | | | |
|---|---|---|---|
| 872,122 | 11/1907 | Guild | 5/413 |
| 872,404 | 12/1907 | Burch | 5/413 X |
| 917,403 | 4/1909 | Benger | 5/413 |
| 1,064,630 | 6/1913 | Fiala | 2/69.5 |
| 1,315,294 | 9/1919 | Fink et al. | 2/69.5 |
| 1,661,768 | 3/1928 | Marshall | 5/413 X |
| 2,036,175 | 7/1936 | Hollander | 2/69.5 |
| 2,572,490 | 10/1951 | Kaplan | 5/413 |
| 2,579,948 | 12/1951 | Miller | 2/69.5 |
| 2,656,540 | 10/1953 | Stephenson | 2/69.5 |
| 3,111,677 | 11/1963 | Artzt | 2/69.5 X |
| 3,831,206 | 8/1974 | Geary | 5/413 |
| 4,158,892 | 6/1979 | Gonzales | 5/413 X |
| 4,217,662 | 8/1980 | Buckman | 2/69.5 |

FOREIGN PATENT DOCUMENTS

| | | | |
|---|---|---|---|
| 638726 | 6/1950 | United Kingdom | 2/69.5 |
| 1263071 | 2/1972 | United Kingdom | 2/69.5 |

*Primary Examiner*—Charlie T. Moon

[57] ABSTRACT

Method of making a sleeping box by taking a blanket or comforter and folding over the bottom of the blanket or comforter in such a way as to form a box like structure when the folded parts are secured, taking the two longitudinal sides that extend up from the bottom of the box to the top, lapping one side over the other and securing the same so as to form a closure.

4 Claims, No Drawings

METHOD OF MAKING A SLEEPING BOX

This invention concerns the method of making a sleeping box from a conventional blanket or comforter. A feature of the invention is that the blanket can be adapted for normal use on a bed when not used as a sleeping box.

Sleeping boxes as distinct from the well known and commonly used sleeping bags are an improvement over the latter in being more spacious and therefore affording more leg room. The distinction between the sleeping box and the sleeping bag is that the former as the name implies is constructed at least at the foot end as a box whereas the sleeping bag is essentially an envelope.

An early example of a combined blanket and sleeping bag was U.S. Pat. No. 917,403. This patent simply employs an oblong blanket folded into three layers, bottom, top and intermediate to form a sleeping bag, wherein the intermediate and top layers are secured at one of their edges and respective ends by buttons. When used as a blanket, the bag is unfolded and spread out so that only the button holes show and the buttons are at the underside.

Another patent that illustrates multipurpose use of a blanket as such or as a sleeping bag is U.S. Pat. No. 2,572,490. This article comprises a plurality of layers one of which is waterproof material wherein the sleeping bag longitudinal edges of the outer layer are folded over inwardly to lie over the main body portion. A slide fastener such as a zipper is mounted to the outermost layer to secure the folded over edges so that the blanket can serve as a sleeping bag.

U.S. Pat. Nos. 1,064,630 and 2,036,175 illustrate the use of sleeping bags that are shaped more or less like boxes. In the former U.S. Pat. No. 1,064,630 the sides form a continuous U shape which are stitched to a top, bottom and end piece. A flapped opening is secured to the top piece for access. In the latter U.S. Pat. No. 2,036,175, the box like structure is adapted to be fitted over a mattress wherein the ends of the bag are secured to the mattress by straps.

U.S. Pat. No. 3,831,206 shows a design of a sleeping bag wherein one form of releasable fastening means used is the Velcro pad, which is the preferred fastening means of applicant's invention. Velcro is a trade name that defines a type of fabric having a pile of looped and cut loops of monofilament fibers such that when the pile of two pieces of the fabric are urged together, yieldingly, a releasable mechanical connection is established therebetween.

As noted from the prior art, sleeping bags used as blankets are well known. Furthermore, sleeping bags in the form of a box are also taught. Additionally, the use of Velcro releasable fastening means is old. Moreover, the combination of an interchargeable blanket and a sleeping box secured at its foot end by releasable fastening means so as to form a box and the particular manner of fastening is unique and has advantages not heretofore recognized.

Accordingly, it is an object of this invention to provide a method of making a sleeping box from a blanket or comforter which can be used interchangeably as a blanket or sleeping box.

Another object is to make a sleeping box of such dimensions as to form ample foot space.

A further object is to provide a method of making a sleeping box using a blanket which can be releasably secured with ease.

The foregoing and other objects and features of this invention will be fully understood by the accompanying detailed description of the method.

It has been found that a suitable material for the combination blanket sleeping box is a 100% polyester fiber such as manufactured by Burlington Industries. An appropriate size is an 86"×86" square about 2" in thickness. For purposes of reference the blanket has an upper side and underside, a top end and a bottom end. The left side is considered as viewed from the bottom end and looking at a plan view of the blanket. The edges are at the periphery of the blanket. Spaced inwardly from the right side about 7" overall and starting from the top edge and continuing to the bottom end of the underside are placed a number of female Velcro pads. Correspondingly, on the top side and at about the edge of the left side of the blanket are spaced male Velcro pads that are spaced continuously from top to bottom so as to be aligned with female pads when the blanket is folded over. At the bottom end of the square the blanket is slitted so as to form five segments, a center segment and two symmetrically arranged segments on either side thereof. Dimensionally the symmetrical segments measure 18"×9", the former being the left and right side dimensions, and the center segment is 32". Measuring longitudinally from the bottom end, the slits are all uniformly 10". At each of the bottom end edges of the top side of the symmetrical segments are fitted male Velcro pads so that each said segment has two male pads. Additionally, the 9" segments have one male pad inwardly from the bottom end adjacent the 18" segment and aligned with the corresponding male pad at the bottom end. Similarly, on the edges of the center segment on the bottom end and underside are placed five female pads. There are two pads on the corners of the bottom ends, and there are two pads that are adjacent one another and spaced from the pads at the respective corners. Starting then from the left side the spacings measure 12½" overall to the end of the third pad, 9" to the next pad and 10½" to the other pad at the right side. Additionally, there are three female pads inwardly about 10" from the bottom end at the edges. These three female pads are spaced inwardly from the respective corners of the segment and in alignment with the three inner pads at the bottom end. All of the pads, both male and female, measure about 2 inches in length and 1 inch in width.

To form the sleeping box the blanket with its pre-cut segments is laid out on a planar surface. The 32" center segment at the bottom end is folded inwardly so that the female pads are now on the top side. The 9" segments are first folded inwardly and then transversely so that the three male pads of the 9" segment mate with the three corresponding female pads on the 32" segment. Consequently, after this operation there will remain two unmated female pads on the 32" segment, one at the bottom end spaced 12½" from the left side and its corresponding pad in alignment therewith and spaced inwardly. Then the corresponding 18" segments are folded over in an overlapping manner. First the 18" segment on the right hand side is folded over so as to engage the previously mentioned unmated female pads of the 32" segment. Then the segment on the left side is folded over so that the two male pads, the one at the bottom end and the one 10" inwardly therefrom and at the left side edge engage the female pads of the right side of the blanket and the remaining unmated male pad of the left hand side engages the female pad at the under side of the 9" segment adjacent thereto. To complete the assembly of the sleeping box, the remaining male pads at the edges of the left side of the blanket extending to the top are fastened in an overlapping manner to the female pads of the right side of the blanket.

The end result is a compact box like structure at the bottom end with ample leg space and an easily assemblable enclosure extending therefrom. When arranged as a sleeping box, the overall dimension at the top end is 3 feet while the dimension at the foot end of the box like structure is 28". To use the sleeping box as a blanket the fastening means are released and the blanket is opened and inverted so that only the female pads will be showing. The dimensions used, while convenient, are only illustrative and other spacings might readily be adapted. Similarly other blanket material than polyester might be used and buttons or other type fasteners might be substituted for Velcro pads; however, a blanket size that measures less than 86" square has proved to be less than satisfactory for its intended purpose of blanket or sleeping box.

What is claimed is:

1. The method of forming a sleeping box that can be used interchangeably as a blanket which comprises laying out a square blanket of adequate size on a planar surface, said blanket having an upper side and an underside, a top end, a bottom end, a left side and a right side as viewed from the bottom end, said blanket having been precut at its bottom end into two pairs of symmetrical segments, the larger segment of each pair being on the right and left side and a center segment adjacent the smaller segment of said pairs being larger than any of said other segments, folding the center segment inwardly towards the top end, folding each of the adjacent smaller segments inwardly and then then transversely over the center segment and fastening the two together with appropriately spaced corresponding male and female fasteners, folding over the right side segment so that said segment overlaps its smaller adjacent segment, fastening the same to the center segment in the same manner as above, then folding the left side segment to overlap the right side segment and fastening the left side segment to its adjacent smaller segment and the right side segment as above, and completing the formation of the sleeping box by folding in overlapping manner the remainder of left side of the blanket over the right side and fastening the same as above by appropriately spaced male and female fasteners extending from the end of the segments to the top end so as to form a box like structure at the bottom end with ample foot space and a compartment of adequate length and breadth to accommodate small to large size persons.

2. The method of claim 1 wherein the material is a 100% polyester fiber.

3. The method of claim 1 wherein the sleeping box is an 86" square 2" thick.

4. The method of claim 1 wherein the method of fastening is by the use of stitched, corresponding male and female pads measuring 2"×1" and sold under the trade name "Velcro".

* * * * *